US005541046A

United States Patent [19]

Cottrell

[11] Patent Number: 5,541,046

[45] Date of Patent: Jul. 30, 1996

[54] BLACK-AND-WHITE FILM FROM WHICH COLOR IMAGES CAN BE EXTRACTED

[75] Inventor: F. Richard Cottrell, Easton, Mass.

[73] Assignee: Polaroid Corporation, Cambridge, Mass.

[21] Appl. No.: 585,707

[22] Filed: Jan. 16, 1996

Related U.S. Application Data

[63] Continuation-in-part of Ser. No. 349,605, Dec. 5, 1994, abandoned.

[51] Int. Cl.[6] ..... G03C 1/825; G03C 1/46; G03C 5/16; G03C 7/46

[52] U.S. Cl. ..... 430/507; 430/21; 430/215; 430/220; 430/363; 430/367

[58] Field of Search ..... 430/21, 215, 220, 430/363, 367, 507

[56] References Cited

U.S. PATENT DOCUMENTS

| | | | |
|---|---|---|---|
| 3,573,044 | 3/1971 | Land | 430/212 |
| 3,625,685 | 12/1971 | Avtges et al. | 430/215 |
| 3,756,816 | 9/1973 | Sullivan | 430/215 |
| 3,853,562 | 12/1974 | Land et al. | 430/220 |
| 4,102,685 | 7/1978 | Taylor | 430/215 |
| 4,379,829 | 4/1983 | Krafft et al. | 430/215 |
| 4,461,824 | 7/1984 | Mehta | 430/215 |
| 5,350,651 | 9/1994 | Evan et al. | 430/507 |
| 5,350,664 | 9/1994 | Simons | 430/507 |
| 5,391,443 | 2/1995 | Simons et al. | 430/507 |
| 5,408,447 | 4/1995 | Cottrell et al. | 358/474 |
| 5,420,003 | 5/1995 | Gasper et al. | 430/507 |

OTHER PUBLICATIONS

EPO Publication No. 0526931, 10 Feb. 1993, M. J. Simons et al.

Research Disclosure, Apr. 1995, No. 372, pp. 254–9, Kenneth Mason Pub. Ltd.

*Primary Examiner*—Richard L. Schilling
*Attorney, Agent, or Firm*—Robert A. Sabourin

[57] ABSTRACT

An accurate digital representation of a color photograph can be obtained by proper registration of blue, green, and red images taken from a black-and-white photographic film having a unique structure including an antiabrasion layer, a first silver halide emulsion layer with silver grains which are sensitive to blue light, a filter layer being transmissive to a band of wavelengths corresponding to a given color other than blue, a timing layer for delaying penetration of processing fluids, a second silver halide emulsion layer with silver grains which are sensitive to the given color, and a base. The film excludes image dyes, dye developers or dye forming materials. The film also excludes components for emitting electromagnetic radiation at a wavelength different than a received wavelength.

12 Claims, 7 Drawing Sheets

BLACK-AND-WHITE FILM FROM WHICH COLOR IMAGES CAN BE EXTRACTED

BACKGROUND OF THE INVENTION

1. Related Applications

This application is a continuation-in-part of U.S. Patent application Ser. No. 08/349,605 filed Dec. 5, 1994 , now abandoned, by F. Richard Cottrell.

2. Field of the Invention

The invention relates generally to a novel black and white photographic film structure and processing method. More particularly, the invention relates to a black and white photographic film which provides color information of an image that can be extracted during processing. The extracted color information can thereafter be digitized and stored, transmitted and/or otherwise utilized to digitally reproduce the original image in color.

2. Description of the Prior Art

The invention is directed to a method of extracting multiple image records from an imagewise exposed silver halide photographic element.

In classical black-and-white photography a photographic element containing a silver halide emulsion layer coated on a transparent film support is imagewise exposed to light. This produces a latent image within the emulsion layer. The film is then photographically processed to transform the latent image into a silver image that is a negative image of the subject photographed. Photographic processing involves development of the film by reducing silver halide grains containing latent image sites to silver, stopping the film development, and fixing the image on the film by dissolving undeveloped silver halide grains. The resulting processed photographic film element, commonly referred to as a negative, is placed between a uniform exposure light source and a second photographic element, commonly referred to as a photographic paper, containing a silver halide emulsion layer coated on a white paper support. Exposure of the emulsion layer of the photographic paper through the negative produces a latent image in the photographic paper that is a positive image of the subject originally photographed. Photographic processing of the photographic paper produces a positive silver image. The image bearing photographic paper is commonly referred to as a print.

In a well known, but much less common, variant of classical black-and-white photography a direct positive emulsion can be employed, so named because the first image produced on processing is a positive silver image, obviating any necessity of printing to obtain a viewable positive image. Another well known variation, commonly referred to as instant photography, involves imagewise transfer of silver ions to a physical development site in a receiver to produce a viewable transferred silver image.

In classical color photography the photographic film contains three superimposed silver halide emulsion layer units, one for forming a latent image corresponding to blue light or blue exposure, one for forming a latent image corresponding to green exposure and one for forming a latent image corresponding to red exposure. During conventional photographic processing the developing agent, oxidized upon reduction of the latent image containing silver halide grains, reacts to produce a dye image with silver being an unused product of the oxidation-reduction development reaction. After development, undeveloped silver halides are removed by fixing and the reduced, i.e. developed, metallic silver is removed by bleaching. The image dyes are complementary subtractive primaries so that yellow, magenta, and cyan dye images are formed in the blue, green, and red recording emulsion layers, respectively. This produces negative dye images (i.e., blue, green, and red subject features appear yellow, magenta, and cyan, respectively). Exposure of color paper through the color negative followed by photographic processing produces a positive color print.

In one common variation of classical color photography, reversal processing is undertaken to produce a positive dye image in the color film (commonly referred to as a slide, the image typically being viewed by projection). In another common variation, referred to as color image transfer or instant photography, image dyes are transferred to a receiver for viewing.

In each of the classical forms of photography noted above the final image is intended to be viewed by the human eye. Thus, the conformation of the viewed image to the subject image, absent intended aesthetic departures, is the criterion of photographic success.

With the emergence of computer controlled data processing capabilities, interest has developed in extracting the information contained in an imagewise exposed photographic element instead of proceeding directly to a viewable image. It is now common practice to extract the information contained in both black-and-white and color images by scanning. The most common approach to scanning a black-and-white negative is to record point-by-point or line-by-line the transmission of a visible or near infrared beam, relying on developed silver to modulate the beam. In color photography blue, green, and red scanning beams are modulated by the yellow, magenta, and cyan image dyes. In a variant color scanning approach the blue, green, and red scanning beams are combined into a single white scanning beam modulated by the image dyes that is read through red, green, and blue filters to create three separate records. The records produced by image dye modulation can then be read into any convenient memory medium (e.g., an optical disc). The advantage of reading an image into memory is that the information is now in a form that is free of the classical restraints of photographic embodiments. For example, age degradation of the photographic image can be for all practical purposes eliminated. Systematic manipulation (e.g., image reversal, hue alteration, etc.) of the image information that would be cumbersome or impossible to achieve in a controlled and reversible manner in a photographic element are readily achieved. The stored information can be retrieved from memory to modulate light exposures necessary to recreate the image as a photographic negative, slide or print. Alternatively, the image can be viewed on a video display or printed by a variety of techniques beyond the bounds of classical photography, e.g., xerography, ink jet printing, dye diffusion printing etc.

One of the drawbacks of conventional digital color photography is the requirement in the film structure of image dyes or dye forming materials necessary for forming a color image. Gasper et al. U.S. Pat. No. 5,420,003 issued May 30, 1995 discloses a basic color film structure devoid of dye forming layers but including three emulsion layer units, two interlayer units and a photographic support. One of the interlayer units must be capable of both (i) absorbing electromagnetic radiation (EMR) within at least one given wavelength region and (ii) emitting EMR within a longer wavelength region than the given wavelength region. The other interlayer unit is capable of reflecting or absorbing EMR within at least one wavelength region. In every case disclosed by Gasper et al., at least one of the interlayers of the basic film structure must be capable of both absorbing EMR in one wavelength region and emitting EMR in a longer wavelength region. This transition of waveforms is known as a Stokes transition or a Stokes shift. The Stokes shift and the subsequent emission of longer wavelength EMR is necessary as taught by Gasper to retrieve the color image records after processing.

SUMMARY OF THE INVENTION

The main objective of the present invention is to overcome the above and other shortcomings in the prior art by providing a film structure from which color images can be extracted. Specifically, the inventive film does not contain any layer or component having (i) dyes or dye forming materials, nor (ii) any Stokes transition capability by emitting EMR in a wavelength region different than an absorbed EMR wavelength region.

An accurate digital representation of a color photograph can be obtained by proper registration of blue, green, and red images of the black-and-white photographic film of the present invention. The film has a unique structure which can be conventionally developed to form a black-and-white print. More importantly, the inexpensive black-and-white film can be used in any conventional camera and when the film is processed, color information of the image can be extracted.

The film includes an antiabrasion layer, a first silver halide emulsion layer which is sensitive to blue light, a filter layer being transmissive to a band of light having wavelengths corresponding to a given color other than blue, a timing layer for delaying passage of the processing fluids, a second silver halide emulsion layer which is sensitive to the given color, and a base. No image dyes or dye forming materials are used in any of the layers or components of the film. No EMR is emitted from any layer or component of the film that is different from any received wavelength.

An accurate color reproduction of an image using the above described black-and-white photographic film can be obtained as follows. During development, the exposed film is scanned with a first infrared (IR) beam to capture the amount of developed silver in the first silver halide emulsion layer, then the film is again scanned with a second IR beam to capture the combined amount of developed silver from both the first silver halide emulsion layer and the second silver halide emulsion layer. The amount of developed silver of the given color is determined by subtracting the amount of developed silver of the first silver halide emulsion layer from the combined amount of silver of both the first and second silver halide emulsion layers. Once the film is completely processed, the digitized color images are stored and available for color reproduction of the image.

Since the black-and-white photographic film requires no image dyes or dye forming materials (conventionally used in color films), the manufacture of the film is simple and inexpensive in comparison to the manufacture of conventional color film. Consumers can use the less expensive black-and-white film of the invention in conventional cameras to obtain digital color data upon processing of the film. Thereafter, the digital color information can be stored, transmitted and otherwise utilized to provide optimum color or black-and-white reproduction of the original image.

BRIEF DESCRIPTION OF THE DRAWINGS

The aforementioned aspects and other features of the invention are described in detail in conjunction with the accompanying drawings in which the same reference numeral denotes the same element in each drawing, and wherein.

DETAILED DESCRIPTION OF THE INVENTION

A novel black-and-white photographic film according to the invention contains color information which can be extracted during processing, then converted to digital format and stored, transmitted or displayed as a reproduced color or black-and-white image.

There is an absence of image dyes, dye developers, dye forming materials or the equivalent from the inventive film (i.e. each layer of the film). Thus, if the film is exposed and developed it will yield a black-and-white positive print. Also, the film (i.e each layer of the film) excludes the capability to emit EMR at any wavelength other than a received wavelength. Specifically, the film excludes emissive EMR capability by way of a Stokes transition or shift which is known to occur when a substance absorbs EMR at one wavelength and emits EMR at a different, longer wavelength.

Figure 1A:
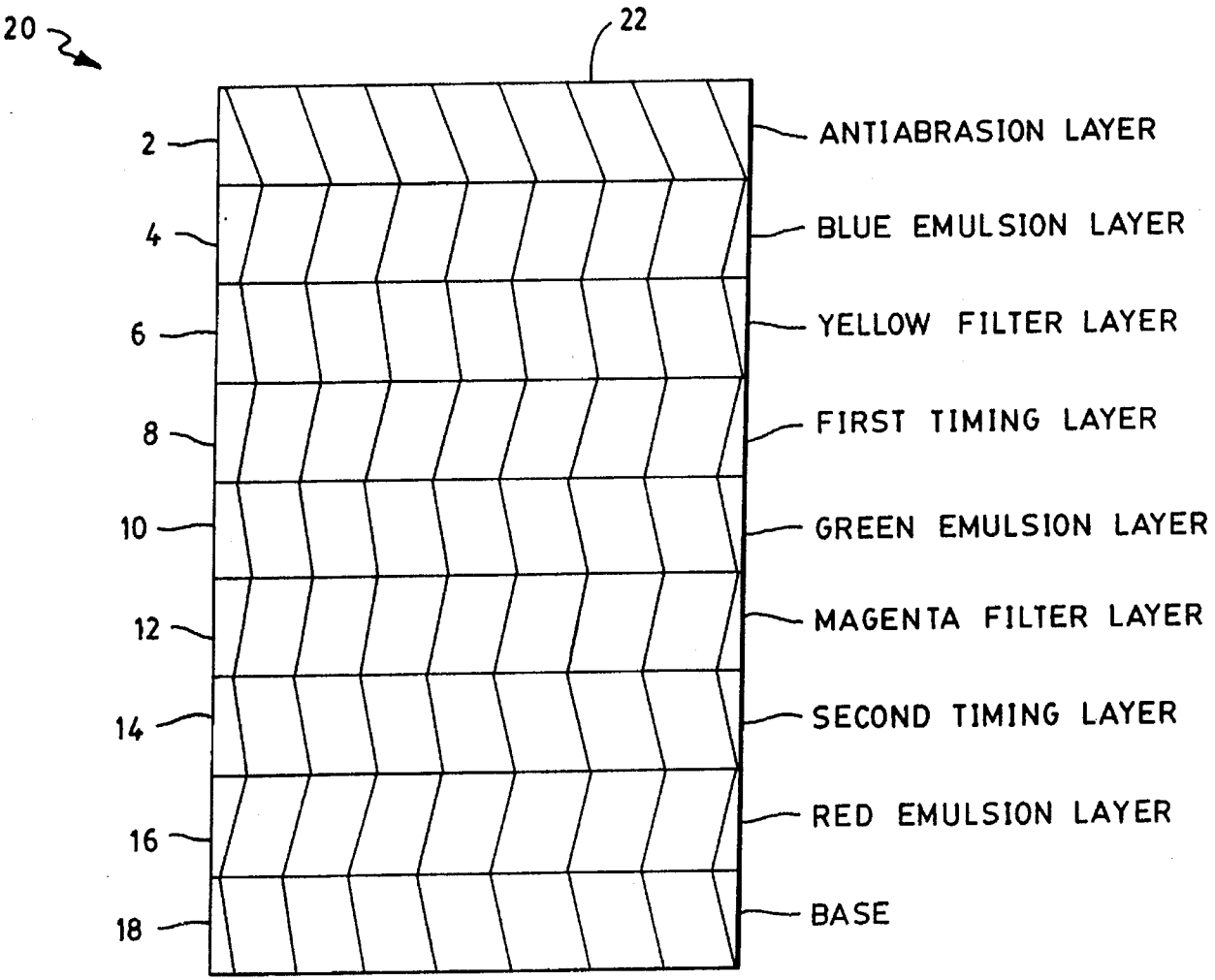
FIGS. 1A and 1B are cross sectional structural views of preferred embodiments of the inventive black-and-white photographic film.

FIG. 1A shows a cross sectional view of the structure of a three color black-and-white photographic film 20 according to the invention. The blue, green and red emulsion layers need not be positioned in the order shown in the preferred structure of FIG. 1A. The blue emulsion layer 4, as well as the green emulsion layer 10 and the red emulsion layer 16, typically includes silver halide emulsions of iodo bromide (AgBrI) immersed in gelatin. The silver iodo bromide emulsions provide optimum performance for conventional silver halide photography, although another silver halide frequently used is silver chloride (AgCl) for applications where development speed is less critical, e.g. print papers. Silver grains, defined as containing one or more silver crystals, are pressure sensitive so that an antiabrasion layer 2 is necessary to maintain the integrity of the film by preventing damage to or development of the film when touched.

During film exposure white light, entering film 20 through the antiabrasion layer 2, forms a latent image on each exposed silver grain in each emulsion layer. The latent image provides the site for development reaction during film processing.

The silver halide grains of each emulsion layer are inherently sensitive to blue light having wavelengths ranging from approximately 400–480 nm. However, a spectral sensitizing dye which adheres to the silver grains during the making of the emulsion can be used to alter the wavelength sensitivity of the silver grains. Typically, red and green spectral sensitizing dyes are applied to the silver grains of the red and green emulsion layers 16 and 10, respectively. The wavelength sensitivity of the silver halide in each emulsion layer can be altered by one or both of (a) varying the halogen concentration in the silver halide, and (b) varying the spectral sensitivity dyes which may be included in any of the emulsion layers during the making of the emulsion. Also, the inherent sensitivity to blue light of the silver halide grains can be compensated by the silver packing of each emulsion layer, i.e. the density or amount of silver halide grains packed into each emulsion layer can be varied.

Filter layers 6 and 12 are provided to absorb certain wavelengths of light during exposure while being transmissive to all other wavelengths. In the film structure of FIG. 1A, the yellow filter layer 6 absorbs blue light and the magenta filter layer 12 absorbs green light. None of the filter layers contain any image dyes, dye developers or dye forming components.

Timing layers such as latex interlayers, shown in FIG. 1A as first and second timing layers 8 and 14, are used in both integral color films and peel-apart instant color films to improve the color rendition of the film. The timing layers are used to provide a time delay in the alkali penetration of a developing negative. For instance, the processing fluids penetrate the antiabrasion layer 2, the blue emulsion layer 4 and the yellow filter layer 6 to instigate development of the silver halides which were sensitive to blue light during exposure. However, the processing fluids are delayed from penetrating the green emulsion layer 10 for a first predetermined period of time for allowing maximum development of the silver halides in the blue emulsion layer 4. After the first predetermined period of time has elapsed, the processing fluids will penetrate the green emulsion layer 10, the magenta filter layer 12, and the second timing layer 14 to instigate development of the silver halides which were sensitized by green image dyes to green light during exposure. The processing fluids are delayed from penetrating the red emulsion layer 16 for a second predetermined period of time for allowing maximum development of the silver halides in the green emulsion layer 10. After the second predetermined period of time has elapsed, the processing fluids will penetrate the red emulsion layer 16 to instigate development of the silver halides which were sensitized by red image dyes to red light during exposure.

Figure 2:
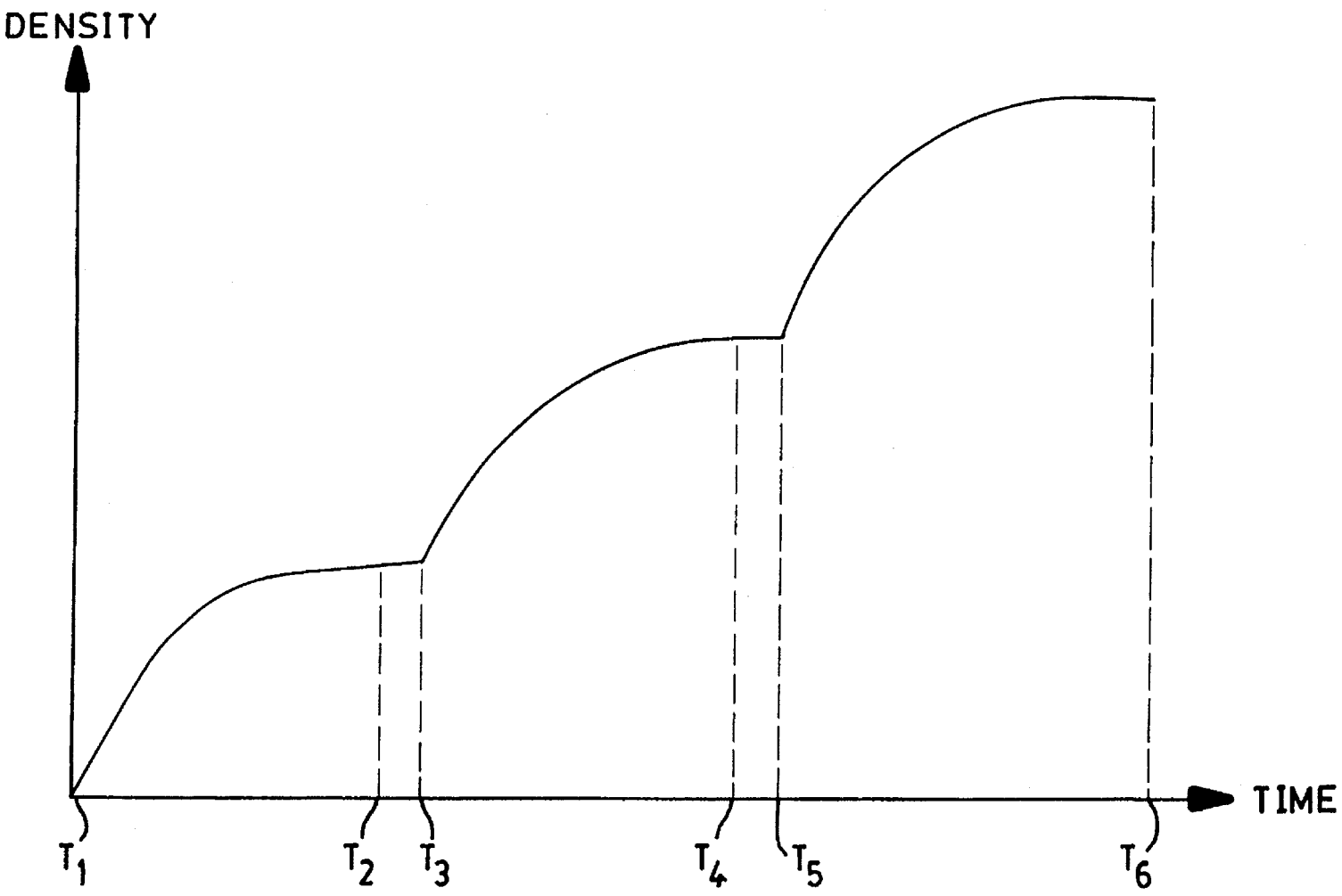
FIG. 2 is an idealized graph of composite developed silver densities versus time for three different color sensitivities.

The effect of the above described timing layers is documented by measurements commonly executed by scanning developing negatives with IR light. The use of IR light for measurements during development obviates the problem of further exposure of the film since the silver grains are not sensitive to the IR light. For example, the idealized graph of FIG. 2 depicts density versus time for a developing film where density, commonly represented mathematically as the negative logarithm of the reflection, is defined as being proportional to the total amount of developed silver of an image. The developed silver density corresponds to IR transmission density determined from scanning an exposed, developing negative with an IR light beam.

Figure 3A:
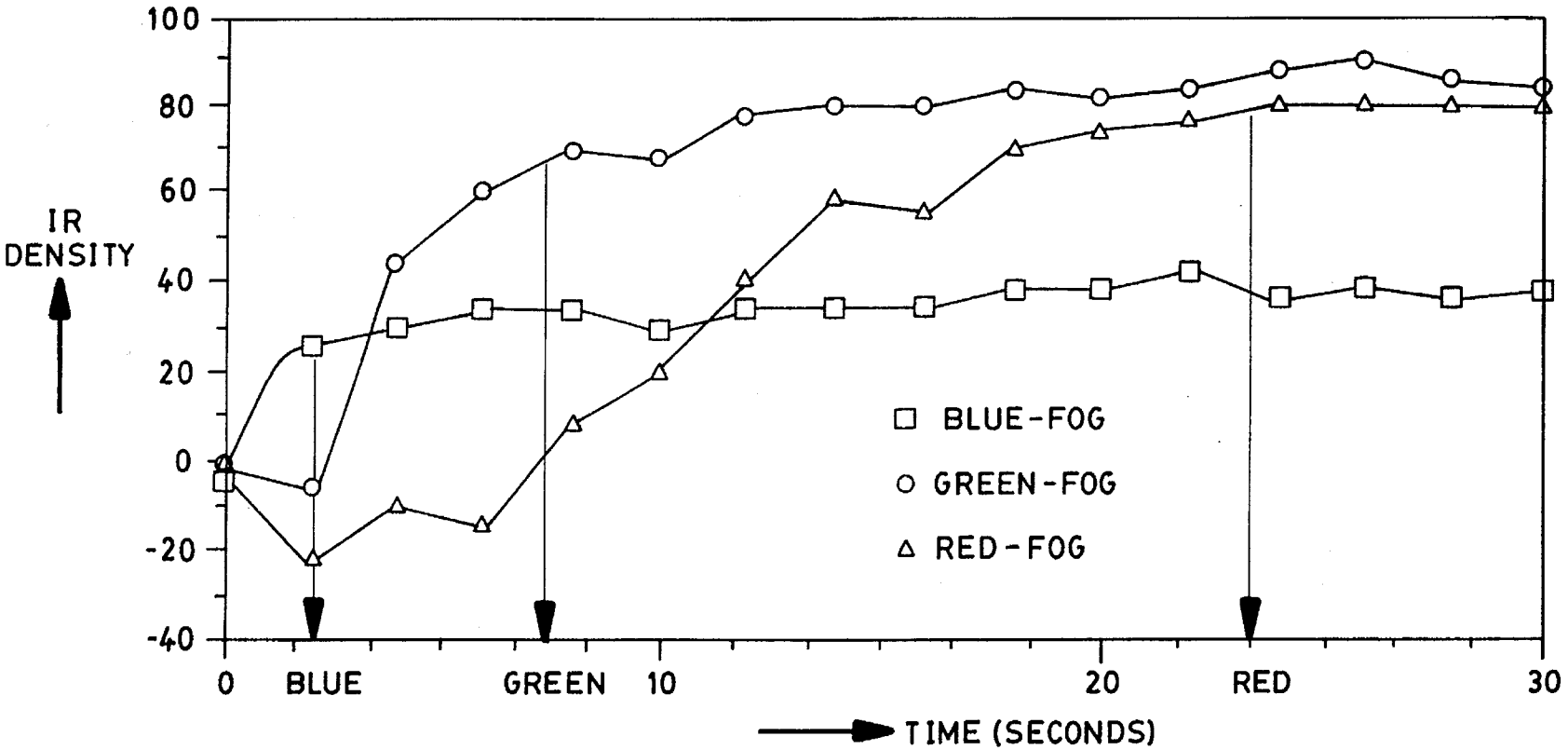
FIG. 3A is a graph illustrating the observed IR density minus fog for materials that have been exposed to blue, green or red light. In the case of blue exposure, immediate IR density buildup is observed and is essentially complete in 3 seconds. In the case of green exposure, IR density buildup is noted at times greater than 3 seconds and is essentially complete in 7 seconds. In the case of red exposure, IR buildup is noted at times greater than 7 seconds and is essentially complete in 25 seconds.
Figure 3B:
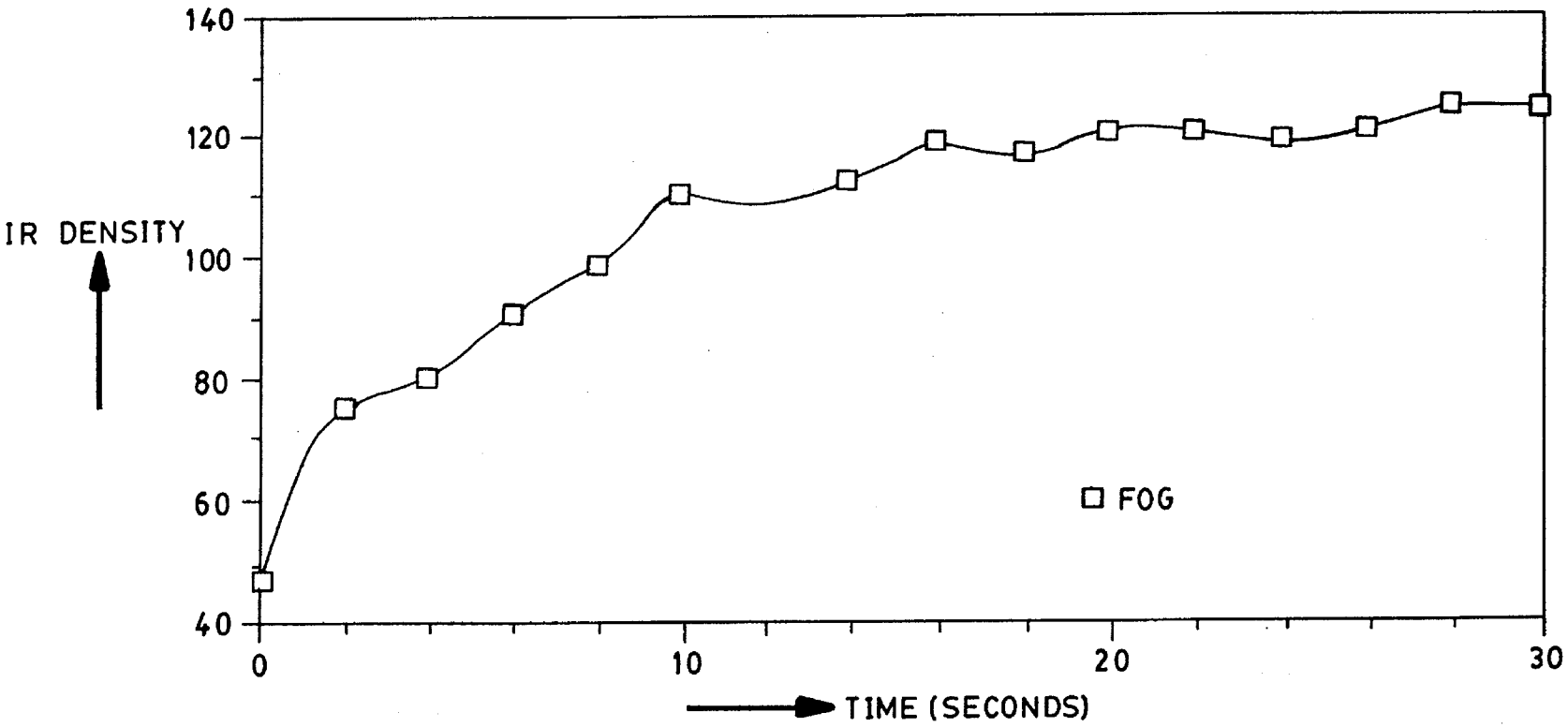
FIG. 3B is a graph illustrating the observed IR density buildup with time without exposure. This signal is the combined fog of blue, green and red emulsions.

Each emulsion layer will exhibit a certain amount of IR density corresponding to fog density which is defined as silver halide density development without exposure. This fog density is akin to noise and should be eliminated or otherwise compensated for during or after the taking of density measurements. The blue fog density is defined as the amount of density development without exposure in the blue emulsion layer 4; the green fog density is defined as the amount of density development without exposure in the green emulsion layer 10; and the red fog density is defined as the amount of density development without exposure in the red emulsion layer 16. FIG. 3A illustrates the observed IR density minus fog for materials that have been exposed to blue, green or red light with respect to time measured in seconds. In the case of blue exposure, immediate IR density buildup is observed and is essentially complete in about 3 seconds; for green exposure, IR buildup is noted at times greater than 3 seconds and is essentially complete in about 7 seconds; and for red exposure, IR buildup is noted at times greater than 7 seconds and is essentially complete in about 25 seconds. The signal of FIG. 3B represents the combined fogs of the blue, green and red emulsions without exposure with respect to time measured in seconds.

Referring to the idealized representation of FIG. 2, the exposed film of FIG. 1A begins development at time $T_1$ (i.e. the blue induction time) when the processing fluids begin penetrating layers 2, 4, and 6. As time passes, the amount of developed silver from the blue emulsion layer 4 increases to a maximum density at time $T_2$. The density at time $T_3$ (which is approximately equal to the density at time $T_2$) is adjusted by subtraction of the blue fog density. The first predetermined period of time described above in association with the first timing layer 8 is equal to $T_3$–$T_1$. At time $T_3$ (i.e. the green induction time) the processing fluids begin penetration of the green emulsion layer 10, the magenta filter layer 12, and the second timing layer 14. The maximum density of the developed silver from both the blue emulsion layer 4 and the green emulsion layer 10 is measured when the developed silver density from the green emulsion layer 10 is maximized at time $T_4$ (which is approximately equal to the density at $T_5$). The density at time $T_5$ is adjusted by subtracting both the blue and green fog densities. The second predetermined period of time described above in association with the second timing layer 14 is equal to $T_5$–$T_3$. At time $T_5$ (i.e. the red induction time) the processing fluids begin penetration of the red emulsion layer 16. The maximum density of the developed silver from the red emulsion layer 16 occurs at time $T_6$ at which time the maximum density of the combined developed silver from blue emulsion layer 4, green emulsion layer 10, and red emulsion layer 16 is measured and adjusted by subtracting the blue, green and red fog densities. The density of developed silver from blue emulsion layer 4 is directly measured at $T_2$; the density of the developed silver from both the blue emulsion layer 4 and the green emulsion layer 10 is measured at time $T_4$; and the developed silver from the blue, green and red emulsion layers 4, 10 and 16, respectively, is measured at time $T_6$. Note that the IR density measurements at times $T_2$ and $T_4$ should take place just prior to induction times $T_3$ and $T_5$ to ensure accurate measurements untainted by further development which could be caused by the processing fluids penetrating a next emulsion layer. The curve of FIG. 2 would of course depend upon the silver packing in each emulsion layer of the film. For instance if the red emulsion layer was lightly packed with spectrally dyed silver halides, then the increased density from $T_5$ to $T_6$ would be less than if the red emulsion layer was heavily packed with spectrally dyed silver halides.

Figure 4:
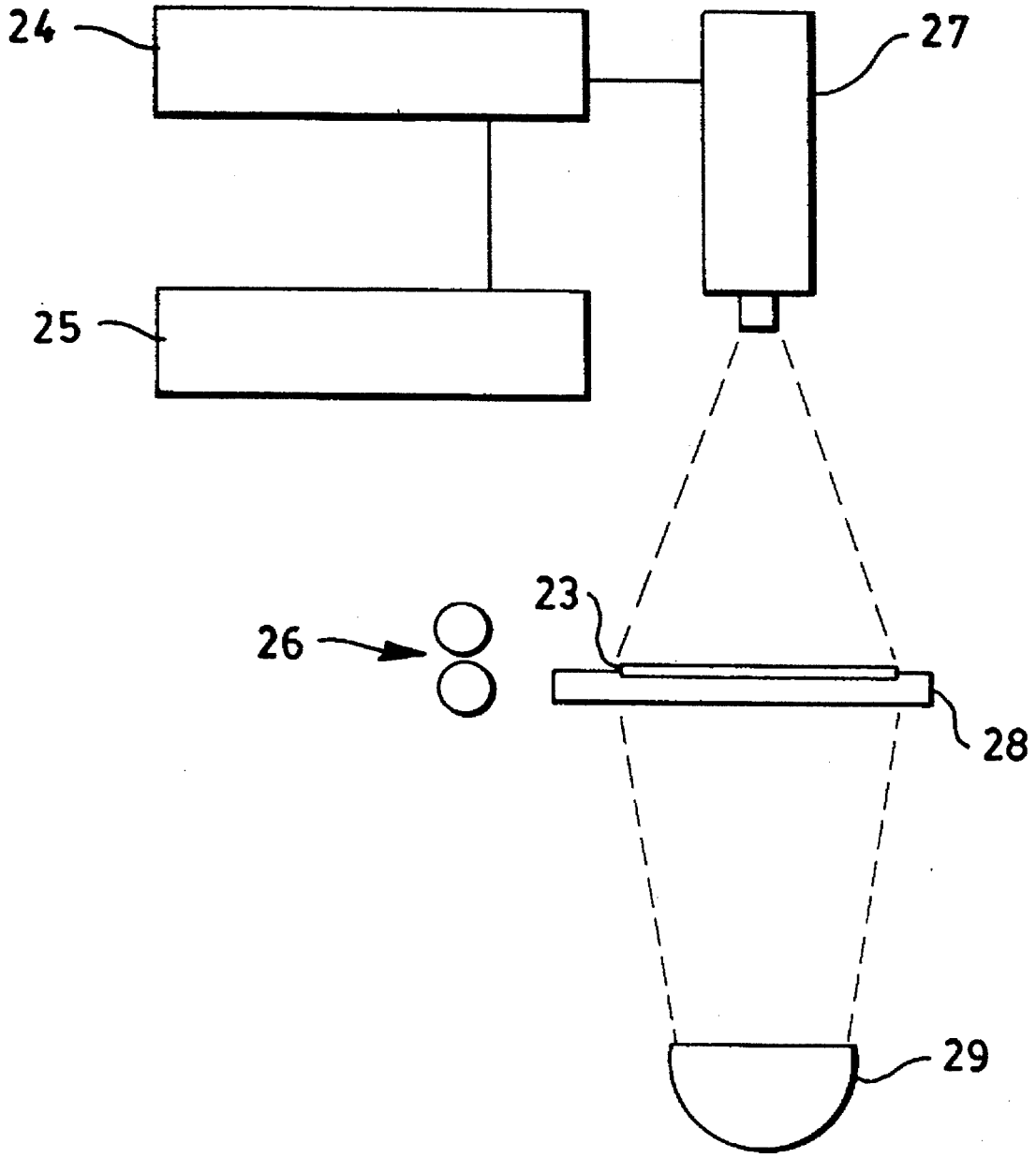
FIG. 4 is a side view of an apparatus for viewing and recording color development information of an exposed black and white Polahybrid film.

FIG. 4 illustrates an apparatus used to capture the color images of a film incorporating the features of FIG. 1A. The apparatus includes a VCR 24, a digital frame grabber 25, a Polaroid high resolution IR sensitive black and white camera 27, motorized lab rollers 26, diffuser 28 and IR light source 29. The conditions for capturing the color image include processing at room temperature with a 0.0046" motorized lab roller gap, and exposing the film through a standard target at 2.0 meter-candle-seconds, 5500K with an integral or analytical sensitometric target. The camera used was a Polaroid high resolution CCD Still/Video System model 8801 with a 12.5 mm focal length, f1.3 Computar lens and close-up rings, and no IR rejection filter. The VCR used was a JVC model HRD180V VHS deck with Polaroid Supercolor T120 tape.

Figure 5:
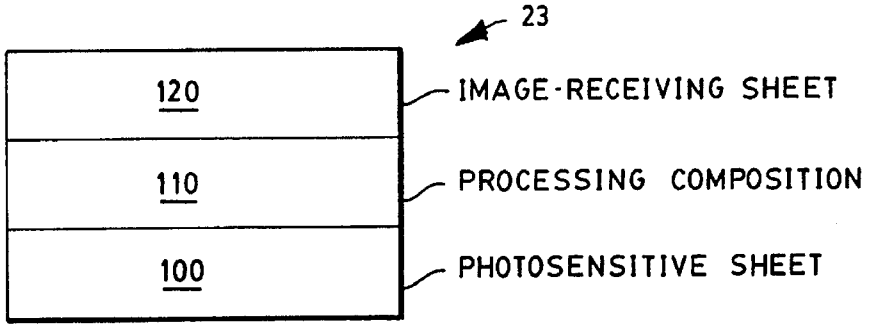
FIG. 5 is a cross sectional view of the structure of an experimental black-and-white photographic film which was reduced to practice.
Figure 6:
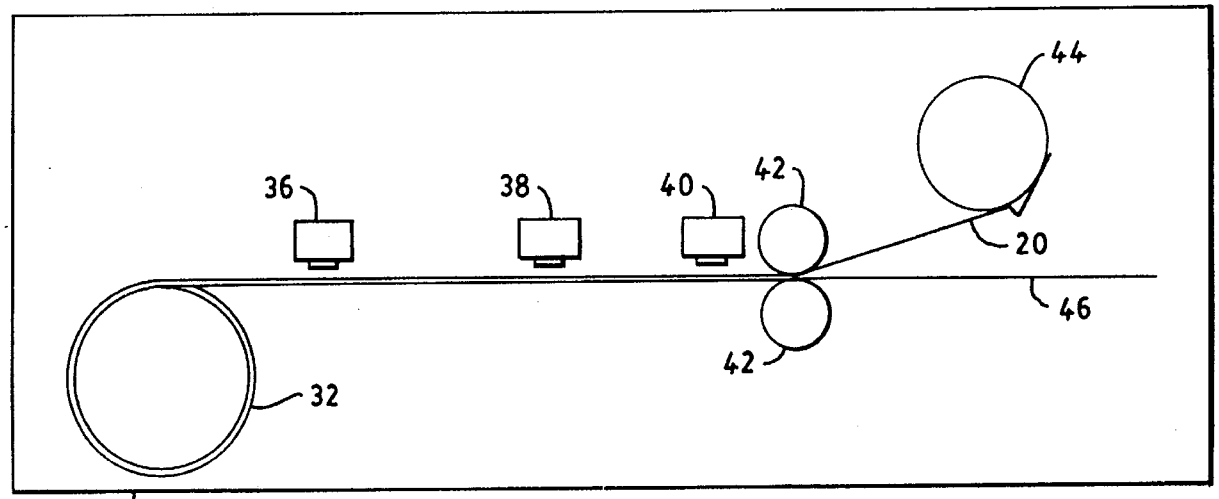
FIG. 6 is a preferred embodiment of a film processor for extracting blue, green, and red images from a black-and-white film during processing.

The experimental film 23 of FIG. 5 was prepared to test the operation of the apparatus of FIGS. 4 and 6 for capturing color images by scanning and extracting color information from the silver halide layers. Note that the experimental film 23 includes many unnecessary layers (e.g. dye developer layers) which are not part of the inventive film as claimed. However, the experimental film 23 is included in this disclosure (i) to ensure that one of ordinary skill in the art can duplicate selected film layers as claimed in the inventive film structure, and (ii) to demonstrate a method for extracting color information from a film in a laboratory setting.

The experimental film 23 when processed includes a photosensitive element 100 comprising a polyethylene terephthalate film base carrying negative or photosensitive layers; a layer 110 of aqueous alkaline processing composition spread from a rupturable pod; and an image-receiving sheet 120. The image-receiving sheet 120 was prepared with the following layers coated in succession onto a subcoated clear polyethylene terephthalate film base having a thickness of 0.178 mm:

1. a polymeric acid neutralization layer, at a coverage of about 32,292 mg/m$^2$ and comprising about 72 parts half-butyl ester of maleic anhydride, about 15 parts ethylene maleic anhydride diacid, about 10 parts polyvinyl butyral, about 3 parts ethylene maleic anhydride, about 0.5 parts Uvitex CAS 12224-40-7 ultraviolet dye, and a trace of titanium dioxide;

2. a time modulating layer, at a coverage of about 21,743 mg/m$^2$ and comprising about 62.2% diethylaminoethyl-substituted hydroxypropyl cellulose (Klucel D-3088, Aqualon Corp., Hopewell, Va.), about 36.4% polyvinyl alcohol, about 1.4% Emulphor ON-870 surfactant and a trace of acetic acid;

3. a dye mordant layer, at a coverage of about 8385 mg/m$^2$ and comprising 85.6% of a graft D polymer comprising 4-vinyl pyridine and vinylbenzyl trimethylammonium chloride grafted onto hydroxyethyl cellulose, about 8.6% formaldehyde/acrolein condensation product crosslinker, about 4.6% hexahydro 4, 5 trimethylene pyrimidine-2-thione (HTPT) antifoggant and about 1.2% Pluronic F-127 polyol surfactant; and 4. a release (strip coat) layer, at a coverage of about 646 mg/m$^2$ and comprising gum arabic, ammonium hydroxide and Triton TX-100 surfactant.

The photosensitive element 100 comprised a clear polyethylene terephthalate film base having the following layers coated thereon in succession:

1. a layer of sodium cellulose sulfate coated at a coverage of about 9 mg/m$^2$;

2. a cyan dye developer layer comprising about 960 mg/m$^2$ of the cyan dye developer represented by the formula

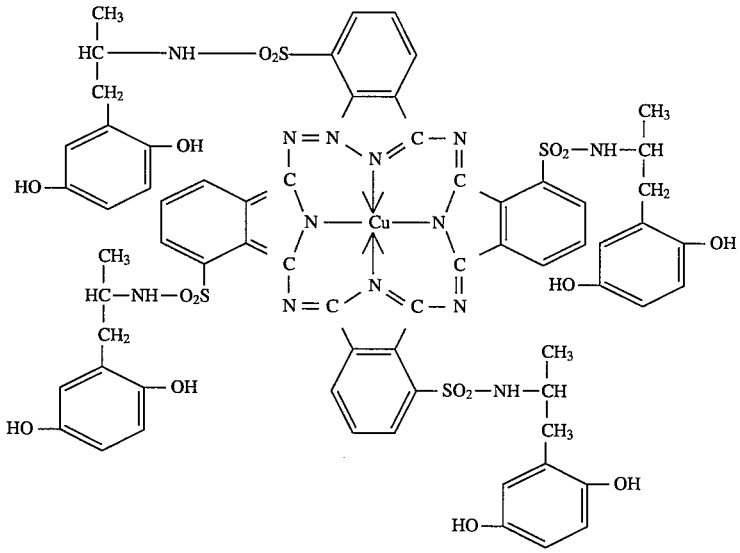

about 543 mg/m$^2$ of gelatin and about 245 mg/m$^2$ of phenyl norbornenyl hydroquinone (PNEHQ);

3. a red-sensitive silver iodobromide layer comprising about 780 mg/m$^2$ of silver (0.6 microns), about 420 mg/m$^2$ of silver (1.5 microns) and about 527 mg/m$^2$ of gelatin;

4. an interlayer comprising about 2325 mg/m$^2$ of a copolymer of butyl acrylate/diacetone acrylamide/methacrylic acid/styrene/acrylic acid, about 97 mg/m$^2$ of polyacrylamide, about 124 mg/m$^2$ of dantoin and about 3 mg/m$^2$ of succindialdehyde;

5. a magenta dye developer layer comprising about 455 mg/m$^2$ of a magenta dye developer represented by the formula

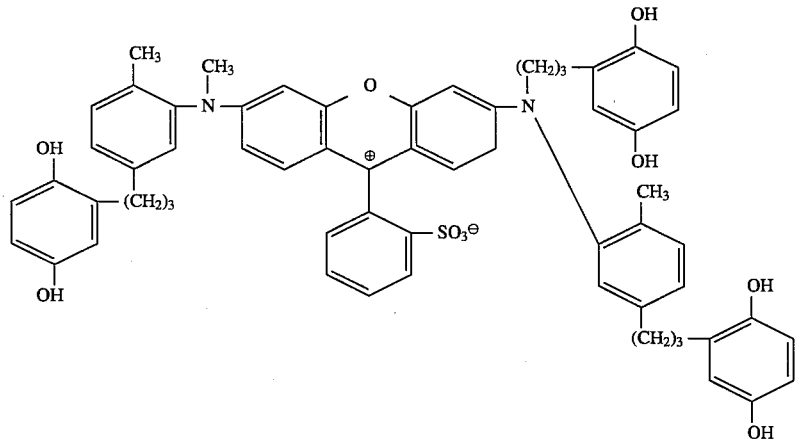

about 265 mg/m$^2$ of gelatin, about 234 mg/m$^2$ of 2-phenyl benzimidazole and about 5 mg/m$^2$ of cyan filter dye represented by the formula

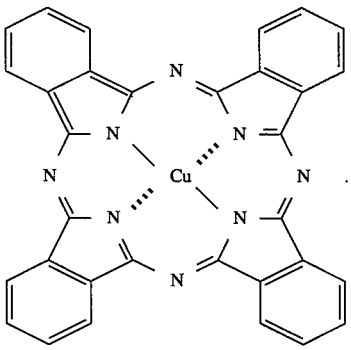

6. a spacer layer comprising about 250 mg/m$^2$ of carboxylated styrenebutadiene latex (Dow 620 latex) and about 83 mg/m$^2$ of gelatin;

7. a green-sensitive silver iodobromide layer comprising about 532 mg/m$^2$ of silver (0.6 microns), about 418 mg/m$^2$ of silver (1.3 microns) and about 417 mg/m$^2$ of gelatin;

8. a layer comprising about 263 mg/m$^2$ of PNEHQ and about 132 mg/m$^2$ of gelatin;

9. an interlayer comprising about 1448 mg/m$^2$ of the copolymer described in layer 4 and about 76 mg/m$^2$ of polyacrylamide and about 4 mg/m$^2$ of succindialdehyde;

10. a layer comprising about 1000 mg/m$^2$ of a scavenger, 1-octadecyl- 4,4-dimethyl-2-{2-hydroxy-5-N-(7-caprolactamido)sulfonamido} thiazolidine, about 416 mg/m$^2$ of gelatin and about 7.5 mg/m$^2$ of magenta filter dye chemically known as 5,12-dihydro-Quino(2,3-b)-acridine-7,14-dione;

11. a yellow filter layer comprising about 331 mg/m$^2$ of benzidine yellow dye and about 165 mg/m$^2$ of gelatin;

12. a yellow image dye-providing layer comprising about 1257 mg/m$^2$ of a yellow image dye-providing material represented by the formula

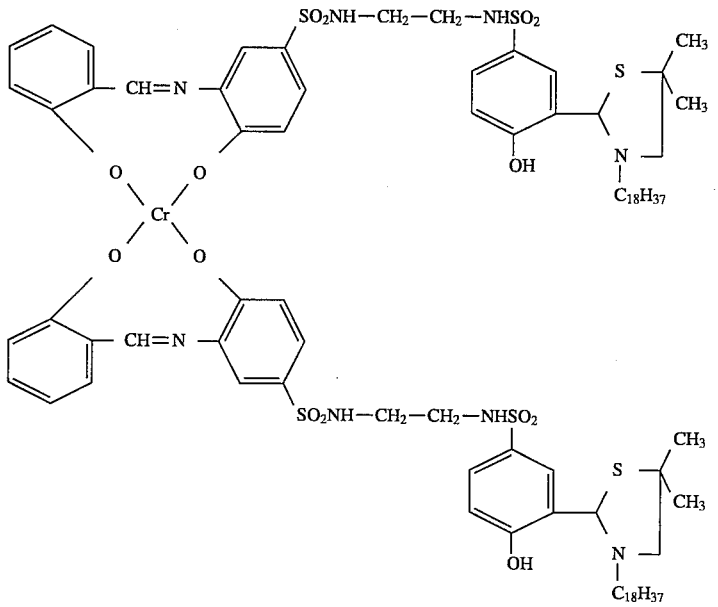

and about 503 mg/m$^2$ of gelatin;

13. about 450 mg/m$^2$ of phenyl tertiarybutyl hydroquinone, about 100 mg/m$^2$ of 2-t-butyl-5,6-diphenylmercapto-tetrazole hydroquinone-di(methylsulfoethylcarbonate) and about 268 mg/m$^2$ of gelatin;

14. a blue-sensitive silver iodobromide layer comprising about 196 mg/m$^2$ of silver (1.3 microns), about 49 mg/m$^2$ of silver (0.6 microns) and about 122 mg/m$^2$ of gelatin;

15. a layer comprising about 250 mg/m$^2$ of an ultraviolet filter, Tinuvin (Ciba-Geigy), about 75 mg/m$^2$ of benzidine yellow dye and about 175 mg/m$^2$ of gelatin:

16. a layer comprising about 400 mg/m$^2$ of gelatin.

The film unit of FIG. 4 was prepared using the above described image-receiving sheet 120 and photosensitive element 100 and a reagent pod (not shown) located therebetween which is a rupturable container containing an aqueous alkaline processing composition. The application of compressive pressure to the pod ruptures a seal along a marginal edge whereupon the aqueous alkaline processing composition is uniformly distributed as layer 110 between the respective elements. The composition of the aqueous alkaline processing composition 110 is set forth in TABLE 1.

TABLE 1

| Processing Composition | |
|---|---|
| Component | Parts by Weight |
| Sodium hydroxide (aqueous solution) | 5.312 |
| Benzatriazole | 1.398 |
| Sulfolane (anhydrous) | 3.914 |
| Potassium thiosulfate (anhydrous) | 0.392 |
| 6-methyluracil | 0.78 |
| Pyrimidine, 4-aminopyrazole-(3,4-d) | 0.078 |
| Zinc nitrate hexahydrate | 0.399 |
| 4,4$_e$-Isopropylidenediphenol | 0.345 |
| 3$_e$5$_e$-Dimethylpyrazole | 0.155 |
| Triethanolamine (aqueous solution) | 0.194 |
| Titanium dioxide | 1.398 |
| Carbon Black (30% dispersion in water) | 3.526 |
| 1-Benzyl-2-picolinium bromide (50% aqueous solution) | 0.392 |

TABLE 1-continued

| Processing Composition | |
|---|---|
| Component | Parts by Weight |
| N-Phenethyl picolinium bromide (50% aqueous solution) | 0.392 |
| Hydroxyethylcellulose | 2.977 |
| Water | Balance to 100 |

The film unit was first exposed through a standard target by a light source emanating through the clear base, and then was processed at room temperature using the apparatus shown in FIG. 4 by spreading the processing composition 110 between the image-receiving sheet 120 and the photosensitive element 100. In order to record the development of the film 23 over a period of time, the film 23 is first ejected into the field of view of the camera 27 by the motorized lab rollers 26 so that silver development may be observed through the clear film base and recorded using the IR sensitive black and white camera 27. Illumination is provided by a safe light (not shown) having a visible light blocking filter which is IR transmissive at wavelengths greater than about 700 nm.

The blue sensitive silver of blue emulsion layer 4 (see FIG. 1A) begins forming at time T1 (see FIG. 2) immediately after the film 23 is placed onto the diffuser 28. The green sensitive silver of green emulsion layer 10 begins forming at time T3 and the red sensitive silver of the red emulsion layer 16 begins forming at time T5. The image development is recorded on the video tape in the VCR 24 and is digitized, frame by frame, to analyze the development rates of the three silver layers.

The black-and-white photographic film of the invention can be used in conventional cameras and other imaging equipment without requiring modification of the existing equipment. The film structure of FIG. 1A can be appropriated to any type of silver halide photographic film including but not limited to integral film, instant film, or slides. Once a picture has been taken by exposing the film in a camera to an original image, the blue, green and red emulsion layers 4, 10 and 16, respectively, will contain color information pertaining to the original image which can be extracted during film processing as described herein.

The film processor of FIG. 6 uses a reagent laden web in place of the pod previously described for carrying the processing composition necessary for film development. The inventive method is directed at extracting the color information from the blue, green, and red emulsion layers 4, 10, and 16 respectively, of the film 20 during film processing. The development of a black-and-white positive as a result of film processing is incidental. In fact after extraction of the color information, the black-and-white photographic film is no longer needed and can be readily discarded since accurate color or black-and-white prints can be readily reproduced from the blue, green, and red color images which have been converted and stored in digital format.

The film processor 30 of FIG. 6 includes a first scanner 40, a second scanner 38, a third scanner 36, a roller 44 for accepting an exposed film negative 20, contact rollers 42, a web roller (not shown) for accepting a reagent laden web 46, and a take up roller 32. The web 46 and film negative 20 are pressed together by rollers 42 and wound onto take up roller 32.

In order to extract color information from the film negative 20 while the film is being developed, first the reagent laden web 46 containing a chemical developer such as hydroquinone is brought into contact with the film negative 20 at rollers 42 where the chemical developer soaks through the first three layers 2, 4, and 6 of the film 20 and the blue induction time is determined as $T_1$ shown in FIG. 2. As earlier stated, the chemical developer is prevented from penetrating the green emulsion layer 10 for a first predetermined period of time by the first timing layer 8. First scanner 40 is positioned so that the developing film (combined with the web) will be scanned by an IR light when the developed silver density of the blue emulsion layer 4 is maximized, as shown in FIG. 2 at time $T_2$. At the green induction time $T_3$ the chemical developer soaks through the first timing layer 8 and into the green emulsion layer 10, the magenta filter layer 12 and the second timing layer 14. At the time $T_4$ when the developed silver density of the green emulsion layer 10 is maximized, the composite developed silver density of the blue emulsion layer 4 plus the green emulsion layer 10 is determined by scanning the film with an IR light from the appropriately positioned second scanner 38. At the red induction time $T_5$, the chemical developer penetrates the red emulsion layer 16. At a time $T_6$ when the developed silver density of the red emulsion layer 16 is maximized, the composite developed silver density of the blue emulsion layer 4, the green emulsion layer 10, and the red emulsion layer 16 is determined by scanning the film with an IR light from the appropriately positioned third scanner 36.

The blue image information obtained from the first scanner 40 is directly measured as described above. The green image information is then determined by subtracting the blue image information from the composite green and blue image information obtained from the second scanner 38. Finally, the red image information is determined by subtracting the blue and green image information from the blue, green, and red information obtained from the third scanner 36. All of the image information is digitally stored so that accurate color and black-and-white prints of the original image can be reproduced.

Although the color subtraction method of determining the blue, green, and red images is described by example herebefore, other known methods for capturing color information could just as well be utilized.

Figure 1B:
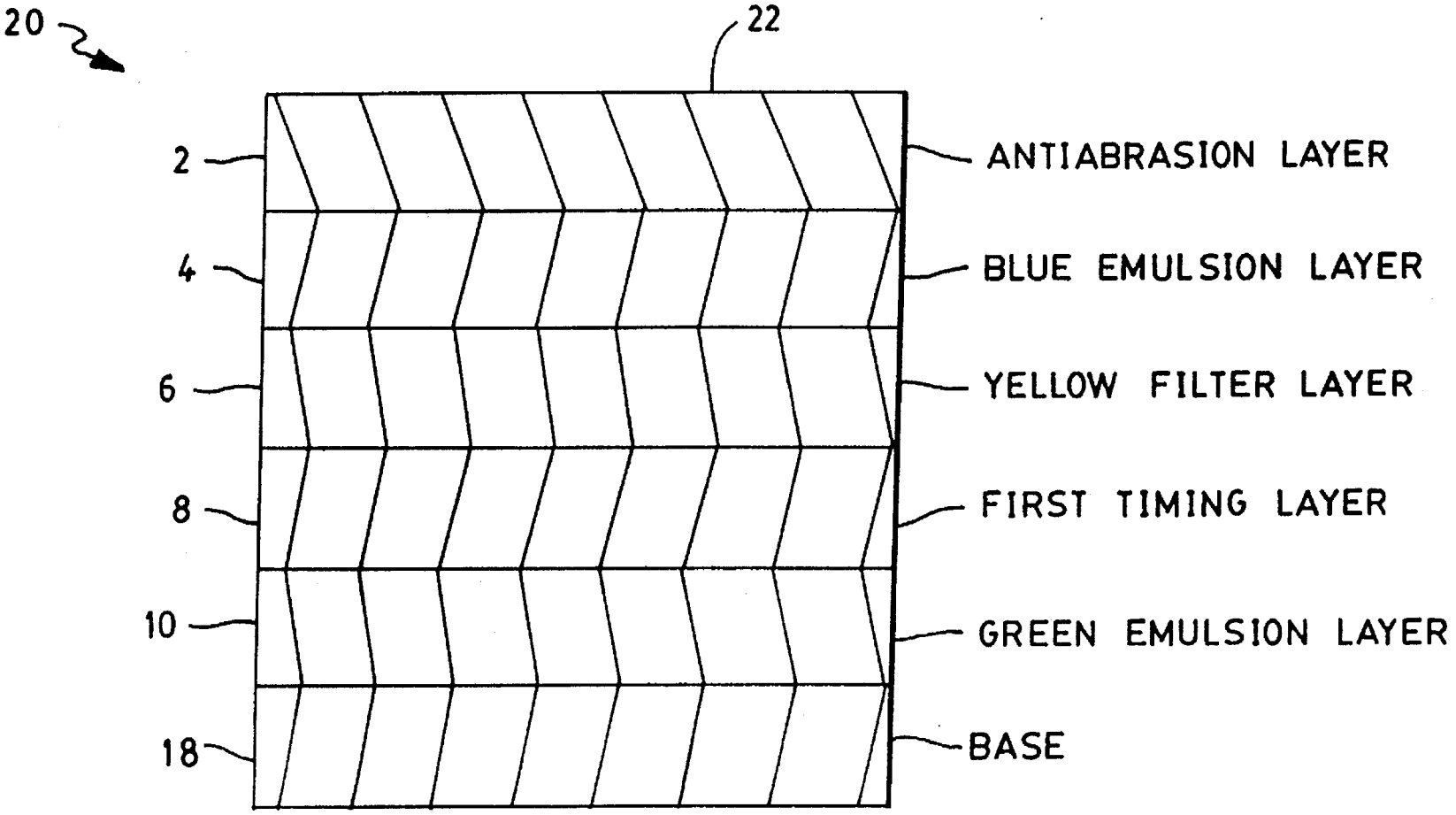

Many variations of the above described embodiments of the novel black-and-white film can be implemented. The fundamental film structure includes just two silver halide emulsion layers although any number of emulsion layers can be fabricated to match specific design requirements. For instance, the fundamental film structure having just two emulsion layers is shown in FIG. 1B as having the antiabrasion layer 2, the blue emulsion layer 4, the yellow filter layer 6, the first timing layer 8, and the green emulsion layer 10 adjacent to the base 18. Since the fundamental film requires only two emulsion layers, then the red emulsion layer 16 and the layers 12 and 14 relating thereto (as shown in FIG. 1A) are not necessary in the most basic film structure of FIG. 1B.

As earlier stated, it is clear that the inventive film (i.e. each layer of the film) excludes image dyes, dye developers, dye forming materials or the equivalent. The film (i.e each layer of the film) also excludes emissive capability at any wavelength other than a received wavelength. Specifically, the film excludes emissive capability by way of a Stokes transition or shift which is known to occur when a substance absorbs EMR at one wavelength and emits EMR at a different, longer wavelength.

The film can be processed by any known means such as chemical baths or pad processing as shown in FIG. 5. Accordingly, the above embodiments are exemplary rather than all inclusive of the many variations and modifications which would be apparent to one of ordinary skill in the art in keeping with the invention as claimed.

What is claimed is:

1. A black-and-white photographic film comprised of film layers, each of said film layers excluding image dyes, dye developers and dye forming materials, each of said film layers excluding emission of electromagnetic radiation (EMR) at a wavelength different than a received wavelength of EMR, said film layers including:

an antiabrasion layer;

a first emulsion layer adjacent to said antiabrasion layer, said first emulsion layer comprising silver halide grains sensitive to a first bandwidth of received EMR, said first emulsion layer encoding a first color image from said silver halide grains sensitive to said first bandwidth of received EMR;

a filter layer adjacent to said first emulsion layer for absorbing said first bandwidth of received EMR and being transmissive to received EMR which is not within said first bandwidth;

a second emulsion layer comprising silver halide grains sensitive to said received EMR not within said first bandwidth, said second emulsion layer encoding a second color image from said silver halide grains sensitive to said received EMR not within said first bandwidth;

a timing layer positioned between said filter layer and said second emulsion layer for delaying development of said silver halide grains within said second emulsion layer for a predetermined period of time so that said first and second color images can be scanned from said first and second emulsion layers, respectively, at different times with an infrared light; and a base layer adjacent to said second emulsion layer.

2. The black-and-white photographic film of claim 1, wherein said filter layer and said base layer are transmissive to infrared radiation.

3. The black-and-white photographic film of claim 1, wherein said emulsion layers and said base layer are reflective to infrared radiation.

4. The black-and-white photographic film of claim 1, wherein said first bandwidth of EMR ranges from about 400 nanometers to about 480 nanometers.

5. The black-and-white photographic film of claim 1, wherein said silver halide grains which are sensitive to the first bandwidth of EMR comprise a first color sensitizing dye, said first color sensitizing dye being sensitive to the first bandwidth of EMR.

6. The black-and-white photographic film of claim 1, wherein said silver halide grains which are not sensitive to EMR within the first bandwidth comprise a second color sensitizing dye, said second color sensitizing dye being sensitive to said EMR which is not within said first bandwidth.

7. A photographic film for encoding color images, said film comprising film layers, each of said film layers excluding image dyes, dye developers and dye forming materials, each of said film layers excluding emission of light at a wavelength different than a received wavelength of light, said film layers including;

an antiabrasion layer;

a blue silver halide emulsion layer adjacent to said antiabrasion layer, said blue silver halide emulsion layer comprising silver halide grains sensitive to blue light, said blue silver halide emulsion layer encoding a blue image from developed said silver halide grains sensitive to blue light;

a yellow filter layer adjacent to said blue silver halide emulsion layer for blocking blue light and being transmissive to non-blue light;

a green silver halide emulsion layer comprising silver halide grains sensitive to green light, said green silver halide emulsion layer encoding a green image from developed said silver halide grains sensitive to green light;

a first timing layer positioned between said yellow filter layer and said green silver halide emulsion layer for delaying passage of processing fluids for developing said silver halide grains sensitive to green light for a first predetermined period of time so that said blue and green color images can be scanned from said blue and green silver halide emulsion layers, respectively, at different times with an infrared light;

a magenta filter layer adjacent to said green silver halide emulsion layer for blocking green light and being transmissive to non-green light;

a red silver halide emulsion layer comprising silver halide grains sensitive to red light, said red silver halide emulsion layer encoding a red image from developed said silver halide grains sensitive to red light;

a second timing layer positioned between said magenta filter layer and said red silver halide emulsion layer for delaying passage of said processing fluids for developing said silver halide grains sensitive to red light for a second predetermined period of time so that said red color image can be scanned by said infrared light source from said red silver halide emulsion layer at a different time than said blue and green color images; and a base layer adjacent to said red silver halide emulsion layer.

8. The photographic film of claim 7, wherein said filter layers and said base are transmissive to infrared radiation.

9. The photographic film of claim 7, wherein said emulsion layers and said base are reflective to infrared radiation.

10. The black-and-white photographic film of claim 7, wherein said silver halide grains sensitive to blue light comprise a blue sensitizing dye.

11. The photographic film of claim 7, wherein said silver halide grains sensitive to green light comprise a green sensitizing dye.

12. The photographic film of claim 7, wherein said silver halide grains sensitive to red light comprise a red sensitizing dye.

* * * * *